US009068239B2

(12) United States Patent
Lenze et al.

(10) Patent No.: US 9,068,239 B2
(45) Date of Patent: Jun. 30, 2015

(54) DEVICE AND METHOD FOR THE FORMING OF BLANKS FROM HIGH AND VERY HIGH STRENGTH STEELS

(75) Inventors: Franz-Josef Lenze, Lennestadt (DE); Sascha Sikora, Lünen (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 1126 days.

(21) Appl. No.: 12/297,543

(22) PCT Filed: Apr. 24, 2007

(86) PCT No.: PCT/EP2007/053986

§ 371 (c)(1),
(2), (4) Date: Jan. 22, 2009

(87) PCT Pub. No.: WO2007/122230

PCT Pub. Date: Nov. 1, 2007

(65) Prior Publication Data

US 2009/0178740 A1 Jul. 16, 2009

(30) Foreign Application Priority Data

Apr. 24, 2006 (DE) ..... 10 2006 019 395

(51) Int. Cl.

| | |
|---|---|
| ***C21D 8/00*** | (2006.01) |
| ***C21D 1/34*** | (2006.01) |
| ***B21D 22/02*** | (2006.01) |
| ***C21D 1/673*** | (2006.01) |

(52) U.S. Cl.

CPC ..... *C21D 1/34* (2013.01); *B21D 22/022* (2013.01); *C21D 1/673* (2013.01); *C21D 2221/00* (2013.01)

(58) Field of Classification Search

USPC ..... 148/620, 648

See application file for complete search history.

(56) References Cited

U.S. PATENT DOCUMENTS

| | | | | |
|---|---|---|---|---|
| 3,605,477 | A | 2/1968 | Carlson | |
| 5,647,922 | A * | 7/1997 | Kim et al. | 148/620 |

(Continued)

FOREIGN PATENT DOCUMENTS

| | | |
|---|---|---|
| DE | 890035 C | 9/1953 |
| DE | 2332287 | 1/1975 |

(Continued)

OTHER PUBLICATIONS

Machine translation of DE2332287.*

(Continued)

*Primary Examiner* — Rebecca Lee

(74) *Attorney, Agent, or Firm* — Reinhart Boerner Van Deuren P.C.

(57) ABSTRACT

A forming tool and a method for the press-hardening and tempered forming of a blank from high and/or very high strength steels are provided, in which the blank is heated before the tempered forming and then formed hot or semi-hot in a forming tool, wherein the forming tool has means for tempering. This is achieved in that the forming tool makes precisely defined temperature guidance of the blank during forming, and in that a plurality of controllable means are provided in the forming tool for tempering the forming tool, by which a plurality of temperature zones can be tempered in the forming tool, wherein at least contact surfaces of forming tool elements used for the tempered forming are allocated to individual temperature zones.

10 Claims, 1 Drawing Sheet

(56) References Cited

U.S. PATENT DOCUMENTS

| | | | | |
|---|---|---|---|---|
| 5,984,588 | A * | 11/1999 | Ferrari | 405/259.5 |
| 6,550,302 | B1 | 4/2003 | Ghosh | 72/342.8 |
| 7,285,761 | B1 * | 10/2007 | Terziakin | 219/633 |
| 2004/0069039 | A1 | 4/2004 | Hammar et al. | 72/342.7 |
| 2005/0257862 | A1 | 11/2005 | Asai et al. | |

FOREIGN PATENT DOCUMENTS

| | | | |
|---|---|---|---|
| DE | 1527957 | | 11/1977 |
| DE | 198 34 510 | | 2/2000 |
| DE | 10 2005 018 974 | | 11/2005 |
| EP | 1407837 | | 4/2004 |
| FR | 2692504 | | 12/1993 |
| JP | 06-055230 | | 3/1994 |
| JP | 6285700 | A | 10/1994 |
| JP | 9262629 | A | 10/1997 |
| JP | 2005177805 | A | 7/2005 |
| JP | 2005329449 | A | 12/2005 |
| JP | 2006104527 | A | 4/2006 |

OTHER PUBLICATIONS

Human translation of DE 2332287, 1975.*
International Search Report for International Application No. PCT/EP2007/053986.

* cited by examiner

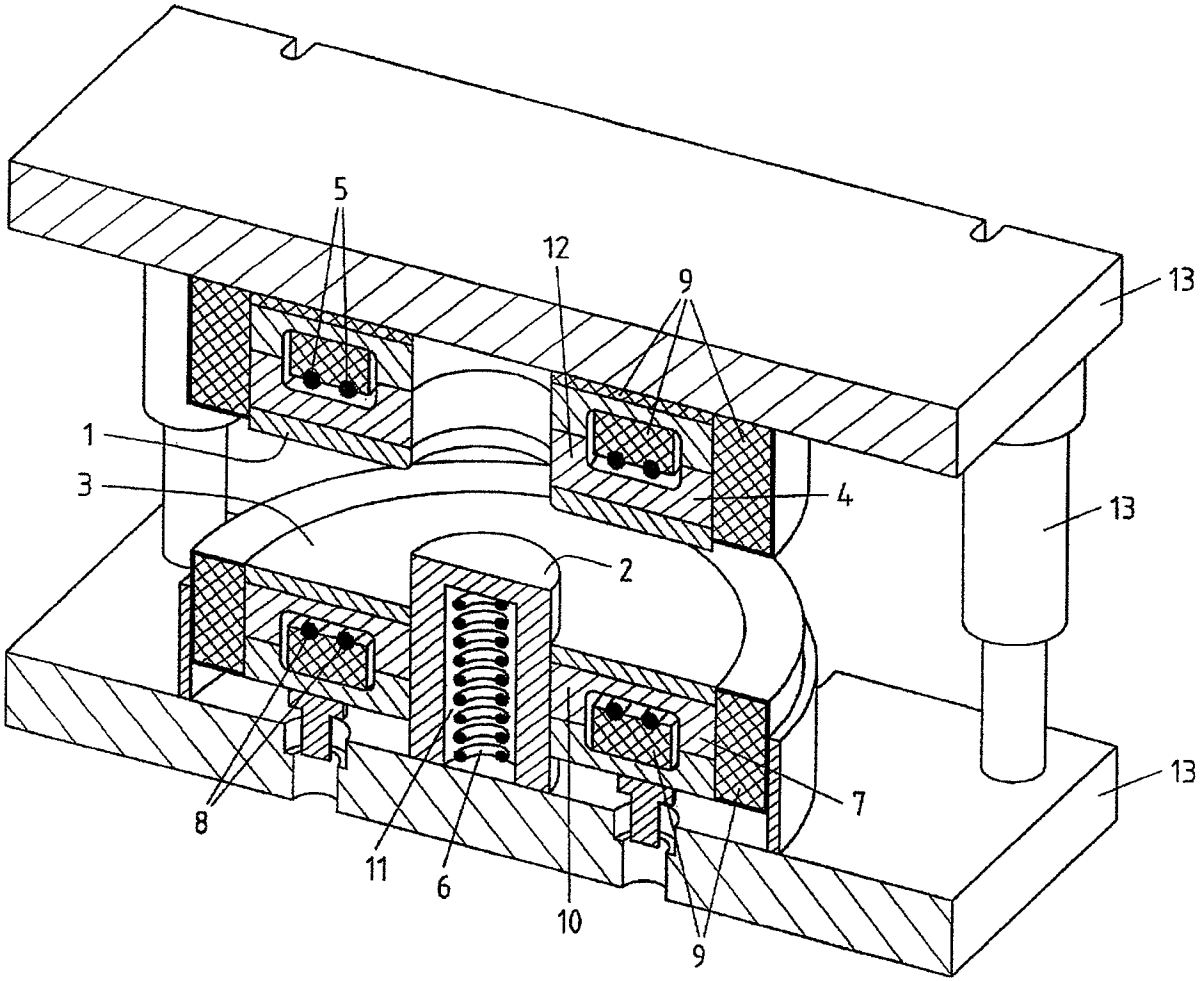
13
13
13
4
7
9
9
2
12
10
6
11
5
8
1
3

DEVICE AND METHOD FOR THE FORMING OF BLANKS FROM HIGH AND VERY HIGH STRENGTH STEELS

CROSS-REFERENCE TO RELATED APPLICATIONS

This application is a National Phase Application of International Application No. PCT/EP2007/053986, filed on Apr. 24, 2007, which claims the benefit of and priority to German patent application no. DE 10 2006 019 395.4-14, filed Apr. 24, 2006. The disclosure of the above applications are incorporated herein by reference in their entirety.

FIELD OF THE INVENTION

The invention relates to a forming tool for the press-hardening and tempered forming of a blank from high and/or very high strength steels with means for tempering the forming tool and to a method for the press-hardening and tempered forming of blanks from high and/or very high strength steels, in which the blank is heated before the tempered forming and then formed hot in a forming tool, wherein the forming tool has means for tempering.

BACKGROUND OF THE INVENTION

Due to constantly increasing demands on strength properties of structural components made of steel or a steel alloy in motor vehicle construction, hot forming techniques are being increasingly used in series manufacture, in order to form high and/or very high strength steels. With hot-forming, a blank is initially heated. This is usually carried out in a furnace. The heated blank is then removed from the furnace and laid in a forming tool, in which the blank is hot-formed. With forming with press-hardening, for example, the blank is heated at least to austenitizing temperature. This is then followed by a rapid cooling of the blank, such that the austenitic microstructure of the blank is converted into a martensitic microstructure. Taking as a basis good forming properties, with the presence of an austenitic microstructure, there is accordingly a perceptible rise in strength values during forming, and therefore a deterioration in the forming properties of the blank. From the German published application DE 10 2005 018 974 A1 a device is known with which blank from a furnace can be laid into a tempered forming tool, wherein, during the removal from the furnace and the laying into the forming tool, by means of contact elements the blanks are kept at desired temperature by current flow. The intention is that the blanks are also formed at the temperatures provided for the hot-forming. In addition, from the German published application DE 198 34 510 A1 a fine cutting tool is known, in which a heating plate with heating elements is arranged in the cutting plate and in the guide plate and a temperature sensor is provided for controlling the heating plates. With the known fine cutting tool, hot-work tool steels can be processed both at room temperature as well as at semi-hot temperature.

A problem with the forming tools known from the prior art is that although they allow tempering of the forming tool, it is not possible to achieve precise control of the blank temperature during the forming.

SUMMARY OF THE INVENTION

In one aspect, the present invention provides a forming tool for press-hardening and tempered forming and a method for press-hardening and tempered forming which allow precisely defined temperature guidance of a blank during forming.

In one embodiment, a forming tool having a plurality of controllable means is provided for tempering the forming tool, wherein a plurality of temperature zones can be tempered in the forming tool, wherein at least contact surfaces of forming tool elements used for forming are allocated to individual temperature zones.

In order to retain good forming properties of heated high strength and/or very high strength steels, it is necessary for the temperature of the contact surfaces of the forming tool elements with the blank to be monitored very precisely. As a result of this invention, it is possible to minimize the wear in the forming tool at the contact surfaces of the forming tool elements with the blank, since a temperature guidance allows optimum process parameters to be adjusted, in particular optimum process temperatures of the blank. In addition, it is possible for an influence to be exerted on a microstructure of the blank, in that cooling rates of the blank during the tempered forming are adjusted in individual temperature zones by detecting a temperature difference in relation to the blank. Accordingly, with embodiments in accordance with the invention, different material properties can be adjusted in the blank. For example, by controlled temperature zones, stress relief annealing can be carried out during and/or after the tempered forming.

In an embodiment in accordance with the invention, controlling of the individual temperature zones can be improved in that at least a number of sensors for temperature measurement is provided corresponding to the number of temperature zones. Preferably, these temperature sensors can be allocated to the individual temperature zones for tempering the temperature zones, such that temperature of each individual temperature zone can be measured, by, for example, thermocouples.

These temperature sensors are preferably arranged in such a way that the temperature can be measured of the contact surfaces, taking part in the tempered forming, of individual forming tool elements. This can be achieved, for example, by the temperature sensors being arranged in immediate vicinity of the contact surfaces. On the other hand, highly thermally conductive inserts can be used, so that the temperature sensors can be located at a distance from the contact surface and nevertheless receive information about the temperature of the contact surface.

In another embodiment in accordance with the invention, means for tempering further include heating cartridges, heating coils, heating wires, or media guide systems for tempered operating media. Non-limiting examples for tempered operating media include oil, water, or gas, wherein the tempered operating media can guarantee both heat emission as well as heat absorption. Although the heating cartridges, heating coils or heating wires generally do not allow heat outflow, they are simple to integrate into the forming tool and are easy to control.

Preferably, means for tempering (i.e. tempering means) are controlled in that actuation means are provided which use the temperature of the means for tempering the forming tool and the measured temperatures of the individual temperature zones to control the emission and/or absorption of heat of the means for tempering the forming tool. By this measure, a direct comparison between reference and actual values of the temperatures of the temperature zones and the temperatures of the tempering means is possible, such that simple and precise temperature controlling of the temperature zones can be achieved.

In another embodiment, insulating means are provided for thermal insulation of a forming tool mounting of the forming tool and/or for thermal insulation of individual forming tool elements from one another. The thermal insulation of the forming tool mounting has the effect on the one hand that no unnecessary heat dissipation occurs via the forming tool mounting. On the other hand, the thermal insulation of individual forming tool elements from one another allows a temperature profile of the individual forming tool elements to be adjusted and therefore a temperature profile of the individual temperature zones to be adjusted, in a process-reliable manner.

In addition to the thermal insulation of the forming tool mounting, preferably at least one separate cooling arrangement for the forming tool mounting is provided in order to keep it the forming tool mounting at a stable temperature level. In particular, by separate cooling of the forming tool mounting a forming tool used in series operation achieves temperature equilibrium substantially more rapidly and therefore more likely keeps process parameters constant.

In another embodiment in accordance with the invention, means are provided for varying the surface pressure of the forming tool. In conjunction with the controlled temperature zones of the contact surfaces of the forming tool elements, varying the surface pressure of the forming tool allows an influence to be exerted on the cooling rate of blank areas or on the blank as a whole. This in principle makes it possible, during press-hardening, to adjust the resultant microstructure and to influence at least in part properties of the blank. For example, at a high surface pressure and a high temperature difference, a very high cooling rate can be set which with high strength and very high strength steels, in particular with manganese-boron steels, leads to a coarse martensitic microstructure. On the other hand, it is also possible, as is frequently desirable, for a fine martensitic microstructure to be set by setting a medium cooling rate.

In one embodiment, forming tool elements include at least one drawing ring, at least one punch and at least one plate holder, wherein the contact surfaces of the drawing ring, the punch, and/or the plate holder form individually controllable temperature zones with the blank, so that a simple forming tool can be provided for press-hardening and tempered forming of a blank made of high and/or very high strength steel.

Preferably, the forming tool is at least designed for the heating of part areas of the forming tool to below the $AC_3$ temperature, in particular to a maximum of 650° C. On the one hand, with press-hardening the blank is laid into the forming tool at temperatures in the range of the $AC_3$ temperature and cools in the forming tool, such that the forming tool can at least for a short time take on the $AC_3$ temperature. On the other hand, reheating of the blank can also take place in the forming tool. With a design of the forming tool for temperatures of a maximum 650° C., more economical hot-work tool steel can be used in the manufacture of the forming tool, such that the costs for the manufacture of the forming tool are reduced.

Another aspect in accordance with the present invention relates to a generic method wherein a blank is formed by contact surfaces of forming tool elements provided in a forming tool for tempered forming, wherein the contact surfaces are at least partially allocated to a plurality of temperature zones provided in the forming tool and a plurality of temperature zones of the forming tool are tempered by means for tempering during the tempered forming in each case to predefined temperature values.

As previously discussed, precise monitoring of the temperatures of the blank is important during forming with press-hardening and tempered forming of blanks made of high and/or very high strength steels, so that not only can the hot-forming properties be well monitored but also an influence on the microstructure can be exerted by controlling cooling rates. According to the invention, this is achieved by individually controllable temperature zones which are allocated to contact surfaces of forming tool elements.

The temperature zones in the forming tool during forming can have uniform or different temperatures. Depending on the application, it is therefore possible, during forming, for a temperature profile to be set inside the blank or for a constant temperature in the formed areas of the blank to be set.

As previously discussed, more economical forming tools can be used in a further embodiment in accordance with the invention, wherein a temperature of the individual temperature zones in the forming tool does not exceed a maximum temperature of 650° C. during the tempered forming. For example, more economical hot-work tool steels can be used for the manufacture of the forming tool.

If a temperature of at least one temperature zone in the forming tool amounts to more than 200° C., then a microstructure of a press-hardened blank in this temperature zone can be adjusted to improved elongation at break under reduced values in relation to yield strength and tensile strength. In addition, due to a higher tool temperature, microstructure fluctuations due to changing surface pressures are reduced. Such reduction may be a result that the fluctuation of the cooling rates is reduced despite different surface pressures at higher tool temperatures.

If the temperature of at least one temperature zone in the forming tool does not exceed 200° C., then in this area maximum yield strength and tensile strength values are achieved, with reduced elongation at break.

A further parameter for influencing the microstructure of the blank during tempered forming can be provided in that a cooling behavior of the blank is at least partially adjusted by surface pressures of the forming tool. In particular in areas of low temperature in the forming tool, i.e. areas with a temperature below 200° C., a variation of the surface pressure leads to clearly different cooling rates, such that the microstructure of the blank in particular in these temperature zones can be changed by the surface pressure.

In another embodiment, particularly high mechanical strength values can be achieved when, for example, a manganese-boron steel is used, in particular a manganese-boron steel of the alloy type 22MnB5. With the steel type referred to, tensile strength values of greater than 1500 MPa and yield strengths of more than 1000 MPa can be achieved, wherein elongation at break A80 lies at about 5%.

In another embodiment, in order to prevent oxide formation on a surface of the blank during the press-hardening and tempered forming, the blanks can have a surface coating to provide protection against oxide formation. For example, corresponding oxide protection of the surfaces of the blank can be provided by an aluminum-silicon coating.

In another embodiment, a microstructure can be specifically adjusted in that a temperature difference between a heated blank and contact surfaces of a tempered tool is adjusted between 50 and 650° C., preferably from 100 to 350° C. The temperature of the blank is understood here to mean the core temperature of the blank. With a temperature difference of 50° C. to 650° C., almost all microstructures can be produced during the tempered forming, including, for example, a ferritic basic matrix at low temperature differences at 50° C. With greater temperature differences between 100° C. and 300° C., substantially bainitic microstructures are produced in the blank by the tempered forming, which have a positive effect on the elongation behavior of the formed blank. At greater temperature differences of more than 300° C., substantially the martensitic microstructure proportion is increased, which does indeed increase the strength, but reduces the elongation capacity of the formed blank.

BRIEF DESCRIPTION OF THE DRAWING

There is now a large number of possibilities for developing and designing further the forming tool according to the invention and the method according to the invention for press-hardening and tempered forming. Provided below is an exemplary embodiment of a forming tool, described in conjunction with FIG. 1.

DESCRIPTION

FIG. 1 shows in a perspective sectional view an exemplary embodiment of a forming tool in accordance with the invention for a press-hardening and tempered forming of a blank from high and/or very high strength steels. Forming tool elements are shown as a drawing ring 1, a punch 2 and a plate holder 3. Arranged in a mounting 4 for the drawing ring 1 are heating wires 5, which temper the heating ring 1 as a first temperature zone. The punch 2 has a heating coil 6, such that its temperature can likewise be controlled. Finally, a mounting 7 of the plate holder 3 comprises heating wires 8 which temper the plate holder 3. The individual temperature zones, which are formed from contact surfaces of the drawing ring 1, the punch 2 and the plate holder 3 with the blank, and the individual heating wires, are insulated by insulating material 9 against heat losses, for example into a tool mounting 13. Individual forming tool elements 1, 2, 3, which form individual temperature zones, are indeed not thermally insulated from one another. However, due to an arrangement of thermocouples 10, 11, 12 in immediate vicinity of the contact surfaces of the forming tool elements 1, 2, 3 with the blank, it is guaranteed that a precise tempering of corresponding areas of the blank can be achieved. As can be seen from FIG. 1, the drawing ring 1 and the plate holder 3 and the punch 2 are thermally insulated against the tool mounting 13, such that uncontrolled heat dissipation into the tool mounting 13 is prevented.

The three temperature zones of the drawing ring 1, the punch 2 and the plate holder 3 can be adjusted independently of one another to different temperatures, from room temperature to, for example, a maximum of 650° C., preferably 200 to 650° C., in particular 400° C. to 650° C. According to the invention, it is therefore also possible for temperature profiles to be created in the forming tool, in order to induce a change in the microstructure at appropriate places in the formed blank, for example on basis of different cooling rates of the blank in these areas. For the sake of simplicity, FIG. 1 does not show the means for varying the surface pressure and the means for actuating the individual heating wires of the temperature zones.

In experiments with blank made, for example, of manganese-boron steel of alloy type 22MnB5, different temperatures have been adjusted in the entire tool. For the sake of simplicity, during the experiments the temperature in the drawing ring 1, punch 2 and plate holder 3 were in each case set to be identical. Due to the position of the thermocouples 10, 11, 12, it is therefore guaranteed that the temperature which has been set will also pertain at the contact surfaces to the blank and therefore corresponds to the forming temperature. In the experiments it was shown that at low tool temperatures, i.e. below 200° C., the highest strength values could be achieved at elongation at break A80 of some 5%. The measured values for the yield strength $R_{P0,2}$ were above 1050 MPa, and for the tensile strength $R_m$ above 1500 MPa. At higher tool temperatures above 200° C., the values for the yield strength $R_{P0,2}$ fell to below 1000 MPa. At the same time, the values for the tensile strength amounted to less than 1500 MPa. The elongation at break A80, however, rose to about 5.8%. For example, at a tool temperature of 400° C. the tensile strength fell to $R_m$=820 MPa and the yield strength to $R_{P0,2}$= 610 MPa. By contrast, the elongation at break rose to A80=10%. The reason for the changes in strength values may be due to the fact that at higher forming tool temperatures there continue to be austenitic fractions present in the microstructure. In order to obtain a microstructure with higher elongation at break values, forming tool temperatures of, for example, 400° C. to 650° C. are therefore preferred. At forming tool temperatures below 200° C., by contrast, the microstructure still consists only of martensite and a maximum strength at reduced elongation at break is attained.

It has additionally been shown that, at an increased tool temperature, different surface pressures had only a slight effect on the microstructure formation. This is attributable to the fact that the different surface pressures, which were varied in a range from 0.15 MPa to 3.83 MPa, caused only slight differences in the cooling rate for the temperature range from 790° C. to 390° C. The cooling rates measured for this temperature range lay between 80 and 115 K/s. However, if the forming tool is tempered to a temperature below 200° C., then, because of the large temperature difference between the blank and the forming tool, the influence of the surface pressure on the cooling rate, and therefore its influence on the formation of the microstructure, is perceptibly greater. At low tool temperatures, i.e. below 200° C., different cooling rates from 80 K/s to 480 K/s could be measured over the surface pressure. This resulted in, at the extremely high cooling rates, a very coarse martensitic microstructure. At cooling rates from 80 K/s to 130 K/s, by contrast, a fine-grain martensitic microstructure resulted, which overall is regarded as being advantageous. The measured values for the yield strength and the tensile strength were not changed due to the different microstructure formations. In order to obtain maximum strength values with press-hardening and tempered forming of high and/or very high strength steels, it is therefore necessary for the temperature guidance to be maintained very precisely in the forming tool and in the blank being formed, respectively. The exemplary embodiment described above is especially well-suited for this purpose.

In addition, two further samples of a 22MnB5 steel alloy with an aluminum-silicon (AlSi) coating were heated for about 6 minutes to 950° C. Sample a) was formed in a tool tempered to 410° C. with a pressure of 80 bar and sample b) in a tool cooled to room temperature with a pressure of 80 bar.

Microsections of samples a) and b) showed different microstructure formations. Sample a) showed a microstructure of bainite with tempering effects. By contrast, with sample b) a martensitic bainitic microstructure could be detected.

A further sample of a 22MnB5 steel alloy was annealed at 900° C. and transferred in about 6 seconds into a press, wherein the core temperature of the sample was still at about 750° C. The temperature of the press amounted to 600° C. and the closure time to about 1.5 seconds. Following the tempered forming, shock cooling to room temperature was effected. An examination of the sample revealed a ferritic basic matrix with linear-arranged perlite, wherein additionally individual martensite islands and bainite portions were identified. With a further grip etching process, slight residual austenite fractions could be revealed. It was possible to show through the experiments that martensite, bainite, and/or perlite, as well as residual austenite in a sample can be in a targeted manner adjusted by tempered forming.

The invention claimed is:

1. Method for adjusting a microstructure of a blank from high and/or very high strength steel during press-hardening and tempered forming of the blank, in which the blank is heated at least to an austenitizing temperature before the tempered forming and then hot-formed in a forming tool having means for tempering, wherein the blank is formed by contact surfaces of forming tool elements provided in the forming tool for the tempered forming, wherein the contact surfaces are at least partially allocated to a plurality of temperature zones provided in the forming tool and each of the plurality of temperature zones of the forming tool is tempered during the tempered forming to pre-defined temperature values and wherein a temperature of at least one of the plurality of temperature zones in the forming tool is greater than 200° C.

2. Method according to claim 1, wherein the plurality of temperature zones in the forming tool have a uniform temperature during the tempered forming.

3. Method according to claim 1, wherein a temperature of the individual temperature zones in the forming tool does not exceed 650° C. during the tempered forming.

4. Method according to claim 1, wherein a temperature of at least one of the plurality of temperature zones does not exceed 200° C.

5. Method according to claim 1, wherein a cooling behaviour of the blank is at least partially adjusted by surface pressures of the forming tool.

6. Method according to claim 1, wherein a manganese-boron steel is used.

7. Method according to claim 1, wherein the blank has a surface coating that provides protection against oxide formation.

8. Method according to claim 1, wherein a temperature difference between a heated blank and the contact surfaces of the forming tool elements is set between 50 and 650° C.

9. Method according to claim 1, wherein the plurality of temperature zones in the forming tool have different temperatures during the tempered forming.

10. Method according to claim 1, wherein a manganese-boron steel of alloy type 22MnB5 is used.

* * * * *